United States Patent [19]

Shatzkin

[11] 3,964,769

[45] June 22, 1976

[54] BOOK BINDING METHOD

[75] Inventor: Leonard Shatzkin, Croton-on-Hudson, N.Y.

[73] Assignee: William C. Heller, Jr., Milwaukee, Wis.

[22] Filed: May 23, 1973

[21] Appl. No.: 362,918

[52] U.S. Cl. ..... 281/21 R; 156/477 B; 281/29

[51] Int. Cl.[2] ..... B42C 9/00; B42C 11/00

[58] Field of Search ..... 281/21 R, 29; 156/477 B; 11/1 R, 1 AD, 3

[56] References Cited

UNITED STATES PATENTS

| | | | |
|---|---|---|---|
| 2,483,465 | 10/1949 | Johnson | 281/29 |
| 2,612,463 | 9/1952 | Brown | 281/21 R |
| 2,657,189 | 10/1953 | Pinkney | 281/21 R |
| 3,093,396 | 6/1963 | Segreto | 281/21 R |
| 3,730,806 | 5/1973 | Heller et al. | 281/21 R |

FOREIGN PATENTS OR APPLICATIONS

| | | | |
|---|---|---|---|
| 894,111 | 3/1944 | France | 281/21 R |

*Primary Examiner*—Jerome Schnall
*Attorney, Agent, or Firm*—Andrus, Sceales, Starke & Sawall

[57] ABSTRACT

An improved technique of forming the hinge joint of a hard bound book. An adhesive is applied over the animal glue on the hinge area of the cover and allowed to dry. Thereafter, the body, coated with a synthetic resin, may be joined to the hinge area to bind the book. Priming the animal glue with the adhesive overcomes the bonding incompatibility which has heretofor existed between the animal glue and the synthetic resins and which has resulted in a weakening of the hinge.

10 Claims, 5 Drawing Figures

BOOK BINDING METHOD

BACKGROUND OF THE INVENTION — FIELD OF THE INVENTION

The present invention is directed to book binding and more particularly to an improved technique for joining the book body to the book case along the hinge area.

BACKGROUND OF THE INVENTION — DESCRIPTION OF THE PRIOR ART

An ordinary hard bound book consists of two main parts, the case and the body. The case comprises the front and the back covers connected by the spine. The covers are hinged along either edge of the spine. An indentation or groove in the case at the spine edges allows the covers to be opened and closed easily.

The body of the book is comprised of a plurality of paper sheets termed leaves. Folded leaves may be sewn together along their centerfolds in groups of sixteen or more to form the sections or signatures of the book. The signatures are assembled by additional sewing, binding to tapes or cords, and the like, to form the body of the book. In the alternative, the leaves may be adhesively joined together along one edge as in a perfect bound book body. At the front and back of the body are affixed folded pages, termed end papers, which facilitate the attachment of the body to the case.

To affect this attachment, a piece of fabric, termed crash, is glued to the rear of the body. The ends of the crash extend along the outside of the end papers on either side of the body. The body is then inserted in the case so that the folds in the end papers are adjacent the spine of the case. A bonding agent is applied to both sides of the crash and to the sides of the front and back end papers adjacent the insides of the covers of the case. The crash is then affixed to the inside of the covers to join the body to the case. The end papers are also pasted inside the covers to enclose the crash and assist in joining the case to the body. The assembled case and the body are placed in a press which forms the groove at either edge of the case spine. When the attachment process, termed "casing in", is complete, the body is bound to the case at the hinge so that the covers and leaves are movable with respect to each other.

From the standpoint of durability and utility of the completed book, the hinge forms a critical consideration. This portion must have sufficient strength to retain the body in the case under conditions of normal wear and tear throughout the useful life of the book. In the past, the strength of the hinge has been lessened because of bonding incompatibilities existing between the various types of adhesives used in construction of the book.

Specifically, polyamide base adhesives are used in forming the case. Such adhesives, which are typically animal glues, are utilized because of their high tack and low cost. To form the cover, a piece of buckram cloth of the desired size is coated with animal glue. The cover boards are placed on the glued cloth and the edges of the cloth folded over the boards to complete the cover.

In the conventional casing in process a synthetic resin, applied to the crash, is used to secure the body in the case. Such resins are employed because of their great ability to withstand flexure and their other desirable properties. However, it has been found that the hinge of the completed book so manufactured is severely weakened because of the inability of the synthetic resin adhesives used on the crash to bond securely to the animal glue on the hinge area of the cover.

Several techniques are available to avoid this bonding incompatibility and improve the strength qualities of the hinge area of the book. One solution is to remove the animal glue from the hinge area of the case after the case is formed. However, it will be apreciated that this glue removal is time consuming and expensive. It also tends to be ineffective because of the residuum of glue left in the weave of the buckram cloth. Another solution is to coat the buckram cloth of the case with glue only at the places where the cover boards are to be applied. This solution is similarly time consuming to effect and it is difficult to assure, as a practical matter, that the animal glue is completely removed.

Still another solution is to use synthetic resins throughout the entire book. However, because the flexural and other properties of such resins are not required in the stiff covers of the case, use of synthetic resins throughout the book is needlessly expensive.

Yet another solution is to interpose a paper case liner between the body and the case. The case liner is glued to the body with synthetic resins and to the case with the animal glue and thus serves to separate the two adhesives, overcoming the bonding incompatibility problem. But unless a relatively high quality of paper is used for the case liner, it has been found that the liner may fail internally, as by delamination, weakening or destroying the book hinge. In order to provide a case liner which has a strength equal to, or greater than, the adhesive bond in the hinge area, it is necessary to use a material of the quality of kraft paper or better, and preferably a paper having strength characteristics which resist or prevent failure. The use of a case liner adds further cost to book production.

SUMMARY OF THE PRESENT INVENTION

The present invention is, therefore, directed to a technique for overcoming the aforesaid problems by providing economical, high strength, hinge area joinder to bound books.

Briefly, the present invention comprises the discovery that a coating or primer applied to the animal glue on the hinge area of the case provides bonding compatibility between the synthetic resins of the body and the animal glue on the case. The result is a great increase in the strength of the hinge area of the bound books.

A primer comprised of a carrier containing a compatible adhesive is allowed to dry on the animal glue after which the synthetic resin coated body may be placed in the case and secured by various techniques to the primed hinge area of the case. The primer on the case may typically be a water based emulsion of polyvinyl acetate.

DESCRIPTION OF THE PREFERRED EMBODIMENT

Figure 1:
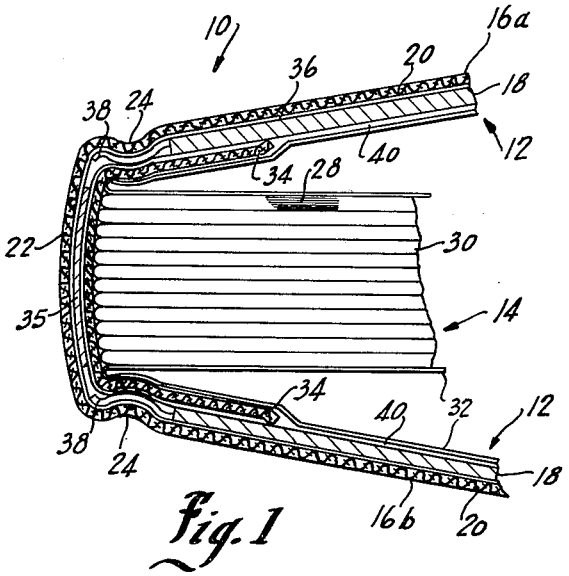
FIG. 1 is a cross sectional view of a book showing in general, the elements thereof.

In FIG. 1 there is shown an assembled bound book 10, of prior art construction, comprised of case 12 and body 14. Case 12 includes front cover 16*a* and back cover 16*b*, each of which is formed of board 18 covered with buckram cloth 20. Buckram cloth 20 connects the boards at spine 22. A groove 24 provided in the buckram cloth at either end of the spine forms a hinge area 26 which permits the covers to hinge on the spine. In accordance with conventional practice, case 12 is formed by completely coating buckram cloth 20 with a polyamide glue, typically animal glue, placing boards 18 on the glued surface, and folding the edges of the cloth over the boards. As a result the buckram cloth in the hinge area of the spine is covered with animal glue.

The body 14 of book 10 is formed of a plurality of leaves 28 folded on a center fold and sewn together to form signatures 30 which comprise the body. End papers 32 are affixed to the front and back of the body. Crash 34 is cemented to the centerfolds of the assembled signatures and extends along the exterior of the end papers between the cover boards and the end papers. Again in accordance with conventional practice, crash 34 is coated with a synthetic resin and joined to the animal glue coated buckram cloth 20 and cover boards 18 on one side and to end papers 32 on the other side to effect a hinge joint weakened by the bonding incompatibility between the animal glue and the synthetic resin. The remaining portions of end papers 32 may be pasted to boards 18. Paper 35 may be applied to the exterior of crash 34.

Figure 2:
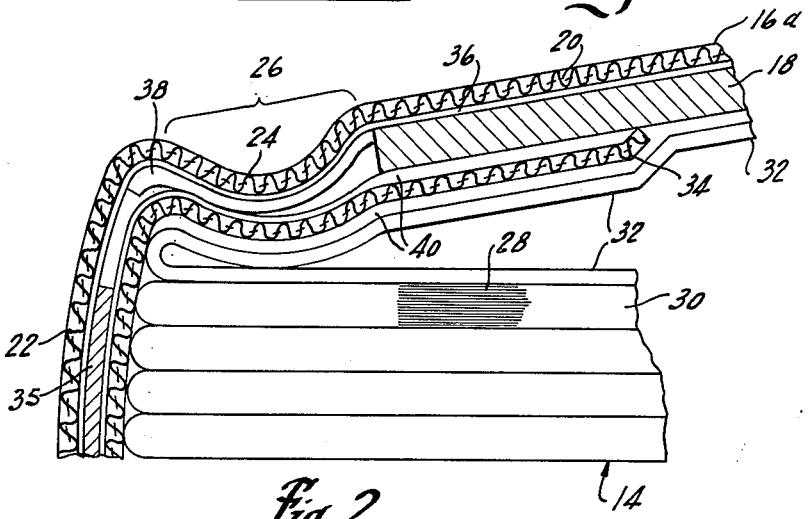
FIG. 2 is a detailed cross sectional view of the hinge area of a book showing the technique of the present invention.

Turning now to FIG. 2, there is shown therein, in detail, the improvement of the present invention. Cover board 18 of front cover 16*a* is affixed to buckram cloth 20 by a polyamide based adhesive such as animal glue 36. As noted above, during the manufacturing process for case 12, the entire inside surface of buckram cloth 20 may be coated with animal glue 36 so that the animal glue extends into the hinge area 26 and across the inside of spine 22.

In accordance with the present invention, animal glue 36 is covered with a coating or primer 38 which provides the bonding compatibility forming a feature of the present invention. The coating may be generally applied throughout hinge area 26, as shown in FIG. 2, or may be applied only to those portions of hinge area 26 which are to be bonded to book body 14.

The desired bonding compatibility may be provided by formulating primer 38 to include an appropriate adhesive compound in a wetting agent carrier. A water base emulsion of polyvinyl acetate has been found suitable for use as primer 38. However, depending on the exact adhesive compound and carrier utilized, primer may take the form of a solution rather than an emulsion and the carrier may be other than water, for example, an industrial solvent. Primer 38 is preferably applied over animal glue 36 while the latter is wet and allowed to dry to provide a compatible surface. If animal glue 36 is not wet, it may be presoftened, as with water, prior to the application of primer 38.

Bonding agent 40 is applied to both sides of crash 34 adjacent hinge area 26. Bonding agent 40 usually comprises a synthetic resin having the desired adhesive strength, flexibility, and other properties. It has been found that through the use of the primer described above a wide variety of synthetic resins may be employed.

Bonding agent 40 may typically be of two general types. One type, commonly termed a "hot melt" rapidly assumes a liquid or semi-liquid adhesive state upon the application of heat thereto and thereafter rapidly returns to a solid state upon the removal of heat. The period of heat induced adhesiveness is often termed the "open time" of the bonding agent. The second type of agent is a liquid adhesive which dries by evaporation to the solid state over a period of time, typically overnight. This type of adhesive is typically applied at room temperature. The use of the former type of adhesive greatly speeds up the book binding process in that the hinge joints are immediately formed. However, the book binding process must be precisely and carefully controlled. The latter type of adhesive is less difficult to work with and provides better penetration of the crash, end papers, etc., due to its lower viscosity. But the binding process takes considerably longer because of the greater drying time of the adhesive. Special precautions may be necessary to insure that the body and case do not become separated while the adhesive is drying.

Bonding agent 40 may also be applied to the inside of boards 18 of covers 16*a* and 16*b* and to the outside of end papers 32. However, since the joinder of body 14 and case 12 is effected at hinge area 26 and because the cover boards and end papers are not subject to flexing, a less expensive paste may be used to fasten end papers 32 to boards 18. The various bonding agents may be applied to the portions of book body 14 during the casing in process or may be preapplied.

Body 14 is inserted in case 12 so that the portion of crash 34 located across the center folds of signatures 30 abuts spine 22. This locates the portion of crash 34 to which bonding agent 40 is to be, or has been, applied at hinge area 26.

Figure 3:
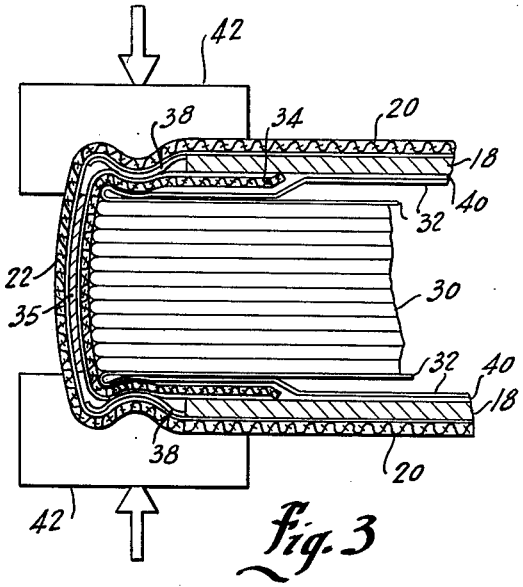
FIG. 3 is a cross sectional view showing a step in the book binding process.

With a hot melt bonding agent 40 applied to crash 34, the crash is placed in contact with primer 38 and heat and pressure applied to hinge area 26 to place bonding agent 40 in the adhesive state and effect the joinder. Heated jaws or platens 42, shown in FIG. 3, may be used to provide the desired heat and pressure.

Thereafter, the heat is removed but the application of pressure to hinge area 26 continued until bonding agent 40 returns to the solid state and crash 34 is firmly bonded to cover 12 at hinge area 26. The pressure may then be removed and the casing in the book 10 is complete.

As noted supra, book 10 so manufactured features high strength in the body-case joint in hinge area 26 due to the application of primer 38 in the wet form over animal glue 36. The superiority of the above described technique thus resides in the surface treatment of animal glue 36 by the primer. The typically water based carrier of primer 38, applied in the wet form, slightly softens the exposed surface of animal glue 36, creating conditions of good adhesion for the adhesive compound of the primer. It has been found preferable to allow the primer to dry before proceeding further with the book binding process. The dried adhesive coating on animal glue 36, in turn, forms the high strength bond with the synthetic resin bonding agent 40 on crash 34.

To accelerate the drying of bonding agent 40, it may be desirable to utilize a bonding agent which is driable upon exposure to a selected form of indirectly applied energy. By the term "indirectly applied energy", it is meant that the energy is supplied through the medium of the radiant field rather than by direct application of, for example, a heated platen. Typically, the radiant fields are electric or magnetic fields.

Such a bonding agent may be formed by selecting a thermoplastic or thermosetting carrier, typically of a synthetic resin, and dispersing therein a material susceptible to heating by indirectly applied energy. The materials may be particulate in form and may comprise fine particles of iron oxide, preferably gamma $Fe_2O_3$ which are heatable by a high frequency magnetic field. Metal particles or ferrite particles may also be used and a material responsive to a high frequency electric field, such as polyvinyl chloride may also be used. In some cases where an alternating electric field is being used, it may be possible to select a dielectrically heatable substance which itself may act as a bonding agent.

Figure 4:
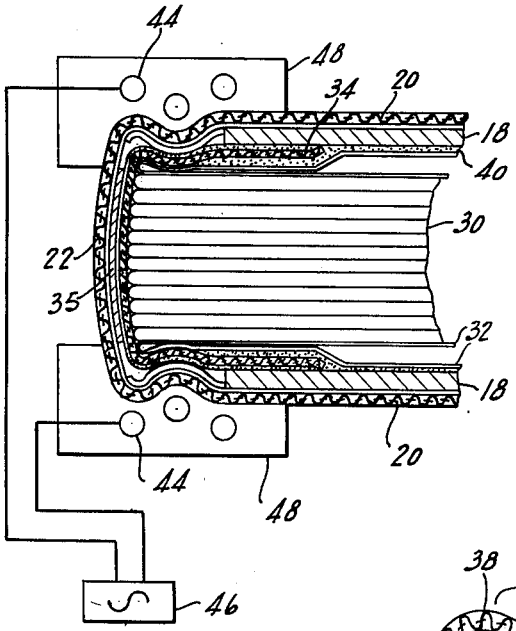
FIG. 4 is a cross sectional view showing the use of indirectly applied energy in the book binding process.

The bonding agent, formed as described above is applied to the book portions prior or at the commencement of the casing in operation. After body 14 is inserted in case 12, the bonding agent is exposed to indirectly applied energy by inserting hinge area into a radiant field. In an instance in which the susceptor is inductively heatable, an alternating magnetic field may be established by coils 44, shown in cross section in FIG. 4 energized by the current of alternating source 46. Upon insertion in the field of coil 44, the susceptor of the bonding agent increases in temperature causing the bonding agent to rapidly liquify and assume the adhesive state. Platen 48, which serves as a support for coils 44, may be used to apply pressure to hinge areas 26 during the open time of the bonding agent. The turn off of alternating current source 46 initiates termination of the period of adhesiveness of bonding agent 40 and thereafter book 10 may be removed from platens 48.

Figure 5:
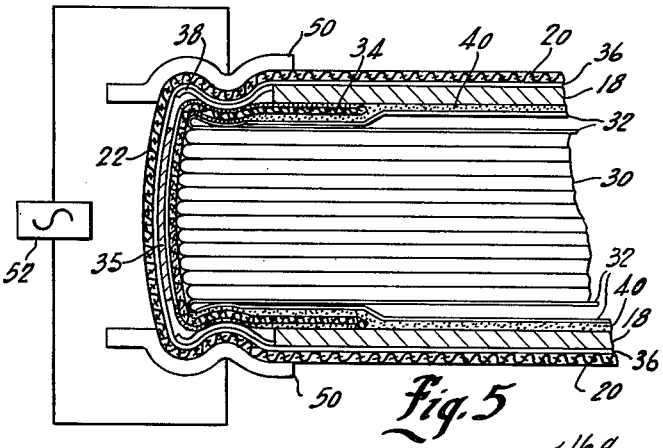
FIG. 5 is a cross sectional view showing the use of a different type of indirectly applied energy in the book binding process.

In the case in which bonding agent 40 is subjected to dielectric heating, case 12 and body 14 may be placed in an electric field created by electrodes 50 energized by an alternating current voltage source 52. The pressure platens may be incorporated in electrodes 50, as shown in FIG. 5.

In the case in which a liquid adhesive is utilized as bonding agent 40, the casing in procedure is similar to that described above except that no heat is applied to the hinge area. The crash, coated with the liquid adhesive bonding agent 40, is placed in contact with primer 38 on the hinge area of the case and pressure applied to the hinge area to join crash 34 and buckram cloth 20 as by binding clamps, or the like. After joinder is secured, the binders clamps are released. A plurality of books bound in such a manner may be stacked under weights until the liquid resin is dry. This typically requires that the books be stacked at least overnight.

Various modes of carrying out the invention are contemplated as being within the scope of the following claims particularly pointing out and distinctly claiming the subject matter which is regarded as the invention.

I claim:

1. A method of securing a book body along the hinge area of a book case, said hinge area having a surface presenting an exposed layer of polyamide glue in the wet state, said method comprising the steps of:

applying an adhesive primer comprised of a polyvinyl acetate adhesive carried in a water base to the layer of glue before the glue has dried, said primer being compatable with said polyamide glue and a bonding agent of the synthetic resin type;

thereafter drying the primer and the glue;

applying said bonding agent of the synthetic resin type to one of the primed hinge areas of the case and the book body said bonding agent having a thermally induced period of liquidity;

allowing said bonding agent to assume a solid state;

applying liquifying heat to the bonding agent;

bringing the primed hinge area of the case and the book body into contact with the bonding agent in the liquid state; and allowing the bonding agent to cool for forming a bond between the hinge area of the book case and the book body.

2. The method according to claim 1 further defined as applying a primer comprised of an emulsion of polyvinyl acetate in a water carrier.

3. The method according to claim 1 further defined as applying a bonding agent having a period of liquidity responsive to exposure to a selected form of indirectly applied energy, exposing the bonding agent to a selected form of indirectly applied energy to induce a short period of liquidity in the bonding agent, and applying pressure to the hinge area at least during the terminal portions of the period of liquidity of the bonding agent to secure the book body to the book case along the hinge area.

4. The method according to claim 3 wherein said bonding agent is heatable upon exposure to an alternating magnetic field and wherein the step of exposing the bonding agent is further defined as exposing the bonding agent to an alternating magnetic field.

5. The method according to claim 3 wherein the bonding agent is dielectrically heatable and wherein the step of exposing the bonding agent is further defined as exposing the bonding agent to an alternating electric field.

6. The method according to claim 3 including an initial step of forming the bonding agent by dispersing particles of susceptor material heatable upon exposure to a selected form of indirectly applied energy in a liquefiable synthetic resin.

7. The method according to claim 6 wherein the step of forming the bonding agent is further defined as dispersing particles of gamma $Fe_2O_3$ in the synthetic resin.

8. The method according to claim 1 further defined as applying a driable bonding agent in liquid form to the primed hinge area of the case or the book body.

9. The method according to claim 1 further defined as applying pressure to the hinge area after application of the bonding agent.

10. The method according to claim 9 further defined as retaining pressure on the hinge area until the bonding agent has dried.

* * * * *